US006065435A

United States Patent [19]

Speil et al.

[11] Patent Number: 6,065,435

[45] **Date of Patent: *May 23, 2000**

[54] VALVE TAPPET ACTUATED BY A CAM OF AN INTERNAL COMBUSTION ENGINE

[75] Inventors: Walter Speil, Ingolstadt; Dieter Schmidt, Nuremberg, both of Germany

[73] Assignee: INA Walzlager Schaeffler oHG, Germany

[ * ] Notice: This patent is subject to a terminal disclaimer.

[21] Appl. No.: 09/436,812

[22] Filed: Nov. 9, 1999

Related U.S. Application Data

[62] Division of application No. 09/364,948, Jul. 30, 1999, which is a division of application No. 09/101,404, filed as application No. PCT/EP96/03260, Jul. 24, 1996, Pat. No. 5,979,385.

[30] Foreign Application Priority Data

Jan. 20, 1996 [DE] Germany ..... 196 02 012

[51] Int. Cl.[7] ..... F01L 1/25

[52] U.S. Cl. ..... 123/90.55; 123/90.51

[58] Field of Search ..... 123/90.48, 90.49, 123/90.51, 90.52, 90.55

[56] References Cited

U.S. PATENT DOCUMENTS

| | | | |
|---|---|---|---|
| 4,648,360 | 3/1987 | Schaeffler | 123/90.55 |
| 4,756,282 | 7/1988 | Kunz et al. | 123/90.55 |
| 4,787,347 | 11/1988 | Schaeffler | 123/90.55 |
| 4,867,114 | 9/1989 | Schaeffler | 123/90.52 |
| 4,951,619 | 8/1990 | Schaeffler | 123/90.55 |
| 5,280,771 | 1/1994 | Groh et al. | 123/90.51 |
| 5,379,730 | 1/1995 | Schaeffler | 123/90.55 |
| 5,586,528 | 12/1996 | Speil | 123/90.51 |
| 5,664,530 | 9/1997 | Ammon et al. | 123/90.51 |
| 5,673,662 | 10/1997 | Rigamonti | 123/90.55 |
| 5,870,985 | 2/1999 | Bretting | 123/90.55 |

FOREIGN PATENT DOCUMENTS

| | | |
|---|---|---|
| 4005261 | 8/1991 | Germany . |
| 4325610 | 2/1995 | Germany . |
| 4343876 | 6/1995 | Germany . |
| 95/06192 | 3/1995 | WIPO . |

*Primary Examiner*—Weilun Lo
*Attorney, Agent, or Firm*—Bierman, Muserlian and Lucas

[57] ABSTRACT

A valve tappet actuated by a cam of an internal combustion engine comprises a cup (1) having a hollow cylindrical skirt (2) and a cup bottom (3) which closes the skirt (2) at one end. On an outer surface, the skirt (2) comprises a peripheral groove (4), and on an inner surface, at least one bead (5). Concentrically arranged within the cup (1) is an inner element (6) whose casing (9) bears against the bead (5, 21). A hydraulic valve clearance compensation element (10) is guided for axial displacement in the inner element (6). To simplify the manufacturing of this valve tappet, it is proposed that the cup (1) is hardened in a heat treatment process, and the inner element (5) is unhardened.

3 Claims, 3 Drawing Sheets

VALVE TAPPET ACTUATED BY A CAM OF AN INTERNAL COMBUSTION ENGINE

PRIOR APPLICATIONS

This application is a division of U.S. patent application Ser. No. 364,948 filed Jul. 30, 1999, which is a division of Ser. No. 101,404 filed Jul. 7, 1998, now U.S. Pat. No. 5,979,385 which is a 371 of PCT application EP96/03260 filed Jul. 24, 1996.

FIELD OF THE INVENTION

The present invention concerns a valve tappet actuated by a cam of an internal combustion engine comprising a cup made of a ferrous material and having a hollow cylindrical skirt and a cup bottom which closes the skirt at one end, said skirt comprising a peripheral groove on an outer surface and at least one bead on an inner surface, there being arranged concentrically within the cup, an inner element comprising a casing which bears against the constriction, while a hydraulic valve clearance compensation element is guided for axial displacement in the inner element.

BACKGROUND OF THE INVENTION

In valve tappets of the pre-cited type, known, for example, from DE-A 4325610, the soft, unhardened inner element is inserted into the soft, unhardened cup and the peripheral groove is then formed by roller burnishing. Inside the cup, the casing of the inner element and the bead formed by the roller burnished peripheral groove are pressed against each other so that the inner element is firmly connected to the cup. Following this, this partly assembled valve tappet is subjected to a heat treatment whereby the cup and the inner element are hardened. At the end of the heat treatment, the inner element has been somewhat deformed so that, to assure a proper guidance of the hydraulic valve clearance compensation element, machining, particularly grinding work, is required on the inner element. For example, the inner element of the prior art valve tappet comprises a guide sleeve in which the hydraulic valve clearance compensation element is guided for longitudinal displacement. After the common heat treatment of the cup and the inner element, the guide sleeve no longer has a circular cylindrical shape so that the inner wall of the guide sleeve has to be ground.

It is the object of the invention to improve a valve tappet of the generic type so that the machining of the cup after its heat treatment can be dispensed with.

SUMMARY OF THE INVENTION

The invention achieves the above object by the fact that the cup is hardened in a heat treatment process, and the inner element is unhardened. This simple solution offers the advantage that, for example, the guide sleeve no longer has to be machined prior to insertion of the hydraulic valve clearance compensation element into the inner element. Altogether, a deformation of the inner element due to thermal loading can be excluded because only the cup is hardened.

For supplying oil to the hydraulic valve clearance compensation element, the known valve tappet comprises an oil channel situated between the skirt and the casing, through which channel, the oil can be pumped to the hydraulic valve clearance compensation element. In an advantageous development of the invention, an annular chamber is defined by the casing and the skirt, which annular chamber serves to delimit the oil channel. Advantageously, the outer diameter of the casing and the clear diameter of the circumferential bead can be configured for forming a press fit with each other. A further bead can advantageously be arranged on the end of the skirt adjacent the cup bottom, against which further bead the inner element then bears. This guarantees, on the one hand, a firm connection between the inner element and the cup. The cylindrical casing of the inner element is supported in both its axial end regions on the beads so that the inner element cannot tilt. On the other hand, the annular chamber which is used to form the oil channel is formed without any additional costs. Appropriately, the peripheral groove comprises an opening communicating with this annular chamber so that oil present in the peripheral groove can be pumped into the annular chamber i. e., into the oil channel.

The inner element of the known valve tappet comprises a funnel which widens towards the cup bottom and merges at its widened end into the casing, while the narrower end of the funnel continues into a guide sleeve in which the hydraulic valve clearance compensation element is arranged. A transition section from the funnel to the casing serves to contact the cup bottom and comprises on its surface facing the cup bottom, a depression which communicates on one side with an oil reservoir defined by the funnel and the cup bottom. According to an advantageous development of the invention, the depression communicates on the other side with the annular chamber. For delimiting the oil channel, advantageously, a filling element,having a low density may be inserted into the annular chamber and a slot provided in the filling element communicates on the one hand with the depression, and on the other hand, with the opening of the skirt. In this case, the filling element, the cup and the inner element define an oil channel.

According to a further advantageous development of the invention, the casing comprises at least one radially widened portion which overlaps the bead in radial direction. The radially widened portion can be made, for example, on the entire circumference by roller burnishing. The widening can be arranged, for instance, between two axially adjacent beads of the skirt and can be advantageously pressed against the bead nearer the open end of the cup. In this way, a firm connection is assured between the inner element and the cup. This firm connection can, however, also be made by stamping circumferentially spaced lugs on the casing which engage positively into recesses of the bead.

In a particularly advantageous method of making the valve tappet of the invention, at first the peripheral groove is roller burnished on the cup, the cup is then subjected to a heat treatment process, following which, the unhardened inner element is inserted into the cup. This fabrication method assures that, following the insertion of the inner element into the cup, the guide sleeve, for example, does not need to be reworked. After the introduction of the inner element into the cup, it is obviously advantageous to roll the casing over on to the bead already formed by the roller burnished peripheral groove. It is economically still more favorable, if the inner element is pressed into the cup, and the outer diameter of the casing and the clear diameter of the bead are configured for forming a press fit with each other. In this way, only one single work step leads to the formation of, on the one hand, the firm connection between the inner element and the cup, and on the other hand, of the already described annular chamber. The press fit further guarantees that the annular chamber is sealed in a gas and/or liquid tight manner at its end remote from the cup bottom.

A secure connection between the inner element and the cup can, however, also be guaranteed if, after insertion of the inner element, the casing is provided with at least one radially widened portion which overlaps the bead in radial direction.

BRIEF DESCRIPTION OF THE INVENTION

The invention will now be described more closely with the help of four embodiments of the invention represented in a total of five figures which show:

FIG. 1, a longitudinal section through a valve tappet of the invention,

FIG. 2, a longitudinal section through a further valve tappet of the invention, FIG. 3, a longitudinal section through a further valve tappet of the invention, FIG. 4, a cross-section through the valve tappet of FIG. 3, FIG. 5, a longitudinal section through a further valve tappet of the invention.

DETAILED DESCRIPTION OF THE DRAWINGS

Figure 1:
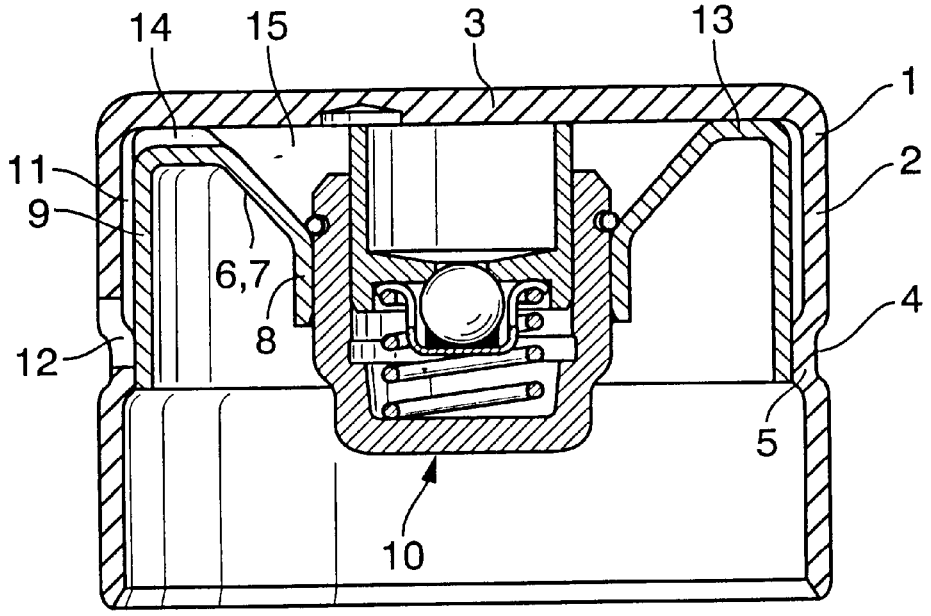

FIG. 1 shows a valve tappet actuated by a cam of an internal combustion engine, not shown, said valve tappet comprising a cup 1 having a hollow cylindrical skirt 2 and a cup bottom 3 which closes the hollow cylindrical skirt 2 at one end. On the outer surface of the skirt 2, there is provided a roller burnished peripheral groove 4 opposite which, on the inner surface of the skirt 2, a circumferential convex bead 5 is formed. Concentrically arranged within the cup 1 is an inner element 6 which comprises a thin-walled funnel 7 that widens towards the cup bottom 3. At its narrower end, the funnel 7 continues into an integrally formed guide sleeve 8 which is concentric to the cup 1, while the wider end of the funnel 7 merges into an integrally formed, hollow cylindrical casing 9 extending concentric to the cup 1. A hydraulic valve clearance compensation element 10 is guided for axial displacement in the guide sleeve 8. The casing 9 is pressed against the bead 5, and the casing 9 and the skirt 2 define an annular chamber 11. The outer diameter of the casing 9 and the clear diameter of the circumferential bead 5 are configured for forming a press fit with each other. The peripheral groove 4 comprises an opening 12 which communicates with this annular chamber 11. A transition section 13 between the funnel 7 and the casing 9 serves to contact the cup bottom 3. On its surface facing the cup bottom 3, the transition section 1 3 is provided with a depression 14 which communicates on one side with an oil reservoir 15 defined by the funnel 7 and the cup bottom 3, and on the other side, with the annular chamber 11. For manufacturing the valve tappet, the peripheral groove 4 is roller burnished on the still soft cup 1. Following this, the cup 1 is subjected to a heat treatment process in which it is hardened. The soft inner element 6 is then inserted into the cup 1. In the example of embodiment of FIG. 1, the inner element 6 is press-fitted into the cup 1.

Figure 2:
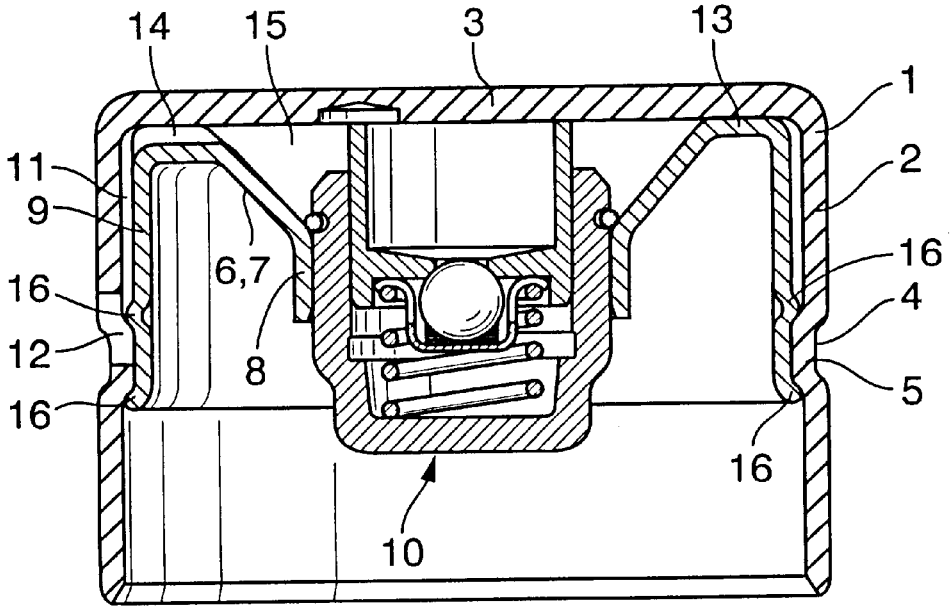

The example of embodiment of FIG. 2 differs from that of FIG. 1 essentially in that the firm connection between the inner element 6 and the cup 1 is established in a further step. Axially on both sides of the bead 5, circumferentially spaced lugs 16 are stamped on the casing 9 to radially overlap the bead 5 while being pressed thereagainst.

Figure 3:
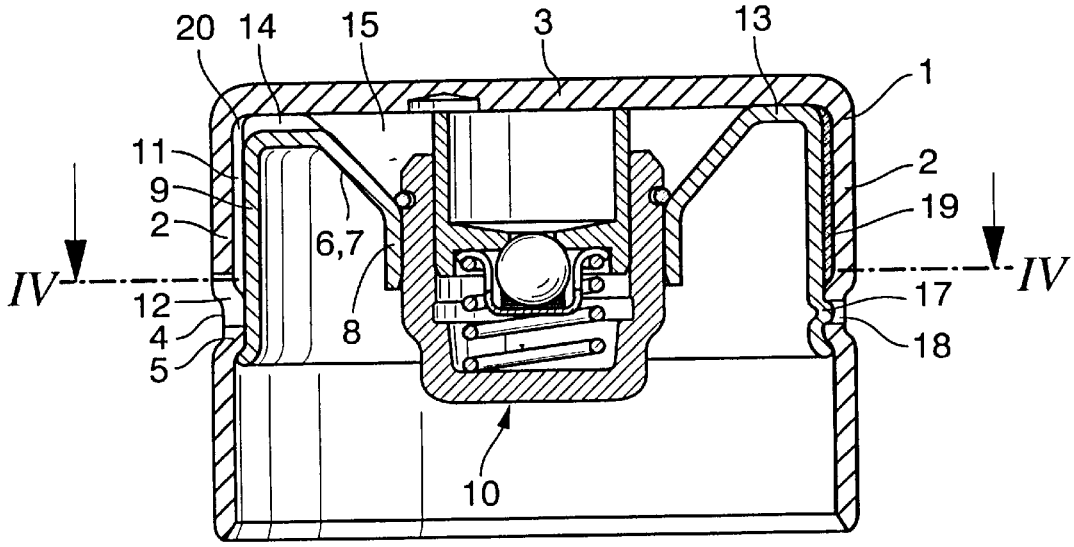
Figure 4:
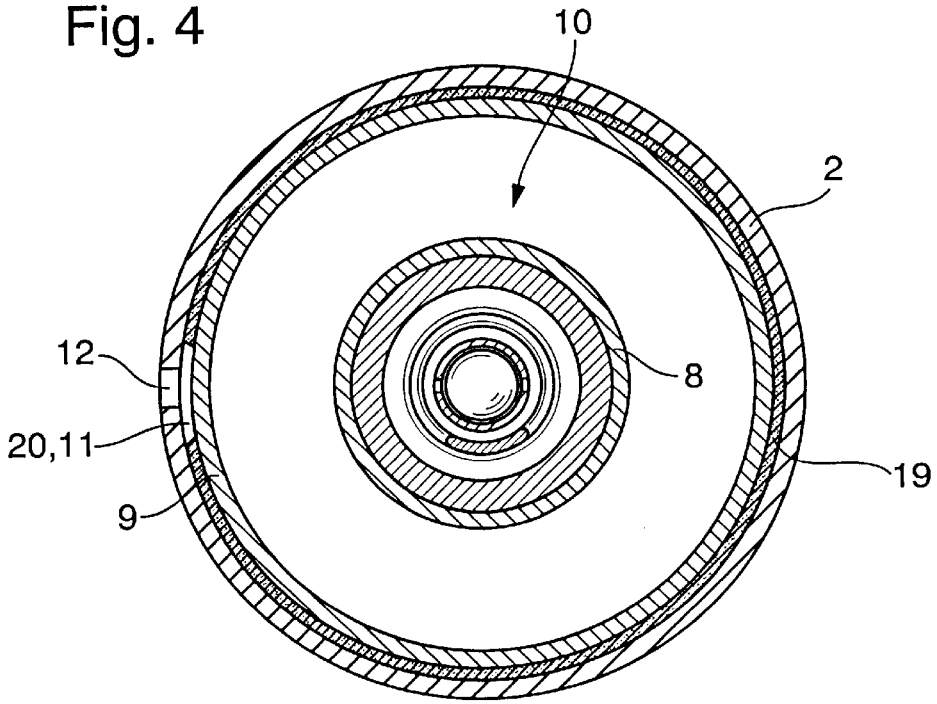

Similar to the example of embodiment of FIG. 2, in the example of embodiment of FIG. 3, the firm connection between the inner element 6 and the cup 1 is likewise established in an additional step. After the insertion of the inner element 6 into the cup 1, the end of the casing 9 is rolled over on to the bead 5. Additionally, a lug 17 provided on the periphery of the casing 9 engages positively into a recess 18 of the bead 5. In this embodiment, in contrast to the two aforedescribed embodiments, a filling element 19 of low density is inserted into the annular chamber 11, and a slot 20 provided in the filling element 19 communicates on the one hand with the depression 14 and on the other hand with the opening 12 of the skirt 8. It is assured in this way that the oil flowing through the opening 12 towards the hydraulic valve clearance compensation element 10 can be pumped only in the region of the slot 20. FIG. 4 shows the annular configuration of the filling element 19 in cross-section. It goes without saying that the filling element 19 is also suitable for use in the other valve tappets described above.

In all the examples of embodiment illustrated herein, the annular chamber 11 is sealed at its end remote from the cup bottom 3 in a gas and/or liquid tight manner.

Figure 5:
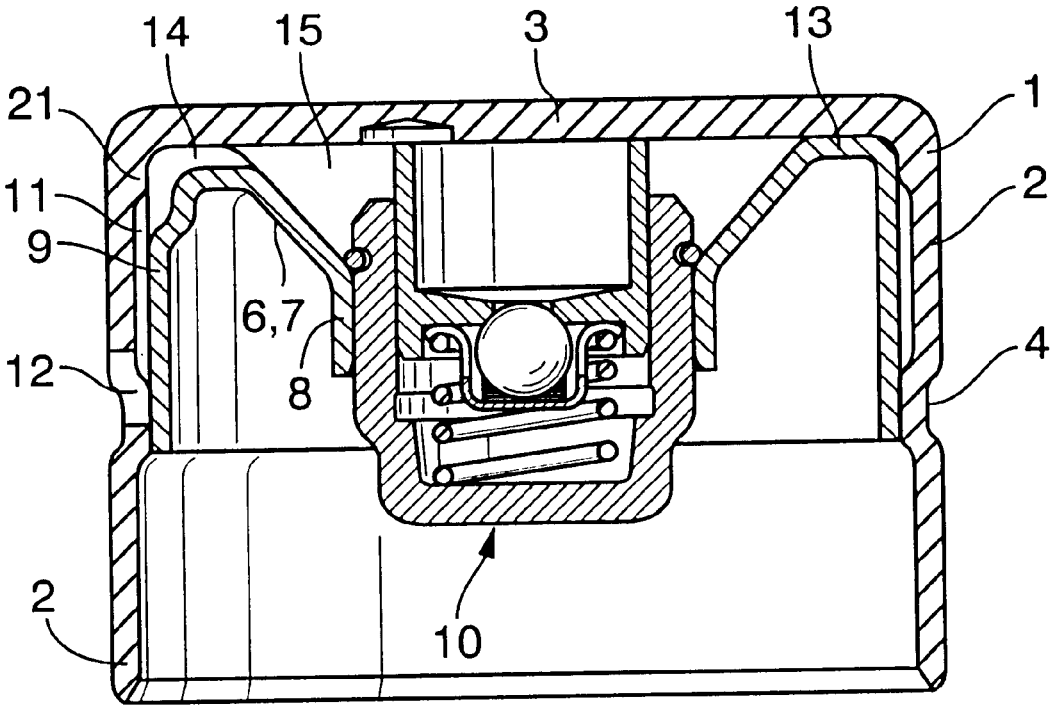

The valve tappet of the invention shown in FIG. 5 differs from that of FIG. 1 essentially in that the skirt 2 comprises a further circumferential bead 21 on its end adjacent the cup bottom 3. The casing 9 of the inner element 6 bears against the bead described earlier herein and against this second bead 21. In this way, it is assured that the inner element 6 cannot tilt. Besides this, the second bead 21 effects a stronger fixing of the inner element 6 relative to the cup 1. To permit a flow of oil from the annular chamber 11 into the oil reservoir, the depression 14 is drawn into the casing 9 of the inner element 6 and is open towards the annular chamber 11.

What is claimed is:

1. A valve tappet actuated by a cam of an internal combustion engine comprising a cup (1) made of a ferrous material and having a hollow cylindrical skirt (2) and a cup bottom (3) which closes the skirt (2) at one end, said skirt (2) comprising a peripheral groove (4) on an outer surface and two beads (5, 21) on an inner surface, there being arranged concentrically within the cup (1), a metal inner element (6) comprising a casing (9) which bears against at least one of the two beads (5, 21) while a hydraulic valve clearance compensation element (10) is guided for axial displacement in the inner element (6), the cup (1) is hardened in a heat treatment process, and the inner element (6) is unhardened wherein the first bead (5) is arranged on the side of the skirt (2) opposite to the peripheral groove (4) and the second bead (21) is arranged on the end of the skirt (2) adjacent the cup bottom (3).

2. A valve tappet of claim 1 wherein the peripheral groove (4) comprises an opening (12) which communicates with the annular chamber (11).

3. A valve tapper of claim 1 wherein the casing (9) and the skirt (2) define an annular chamber (11).

* * * * *